US006991398B2

(12) United States Patent
Leemans et al.

(10) Patent No.: US 6,991,398 B2
(45) Date of Patent: Jan. 31, 2006

(54) TOOL COUPLER

(75) Inventors: Ronald Anthony Leemans, Moline, IL (US); David Michael O'Brien, Dubuque, IA (US); George Robertson, Spanish Fork, UT (US); Gregory Keith Werner, Durango, IA (US)

(73) Assignee: Deere & Company, Moline, IL (US)

( * ) Notice: Subject to any disclaimer, the term of this patent is extended or adjusted under 35 U.S.C. 154(b) by 0 days.

(21) Appl. No.: 10/454,088

(22) Filed: Jun. 4, 2003

(65) Prior Publication Data

US 2004/0247382 A1 Dec. 9, 2004

(51) Int. Cl.
*B25G 3/18* (2006.01)
*E02F 3/96* (2006.01)

(52) U.S. Cl. ..... 403/324; 403/321; 403/322.1; 403/322.3; 37/468

(58) Field of Classification Search ..... 403/321, 403/322.1, 322.3, 324, 408.1; 37/468; 414/723; 172/272–275

See application file for complete search history.

(56) References Cited

U.S. PATENT DOCUMENTS

| | | | |
|---|---|---|---|
| 3,243,066 | A | 3/1966 | Gardner et al. |
| 3,760,883 | A | 9/1973 | Birk |
| 4,625,988 | A | 12/1986 | Witchey et al. |
| 4,708,579 | A | 11/1987 | Baird et al. |
| 5,310,275 | A | 5/1994 | Lovitt |
| 5,562,397 | A | 10/1996 | Albright |
| 5,692,850 | A | 12/1997 | Kimble et al. |

FOREIGN PATENT DOCUMENTS

| | | |
|---|---|---|
| DE | 1 291 284 | 4/1965 |
| WO | WO 01/34916 | 11/2000 |

*Primary Examiner*—Daniel P. Stodola
*Assistant Examiner*—Victor MacArthur

(57) ABSTRACT

A tool coupler comprises a coupler frame and an attachment frame. The attachment frame is provided with two hooks that engage two catches located on the coupler frame. The coupler frame is provided with two locking pins and the attachment frame is provided with two receiving apertures, for locking the coupler frame to the attachment frame. Both locking pins are actuated by a double acting hydraulic cylinder. The hydraulic cylinder is slidably mounted on the coupler frame. The hydraulic cylinder is provided with a barrel end having the first locking pin and a piston rod having the second locking pin. The coupler frame and the hydraulic cylinder are provided with limiters which limit the sliding movement the piston rod and the barrel end relative to the coupler frame.

20 Claims, 4 Drawing Sheets

FIG. 1
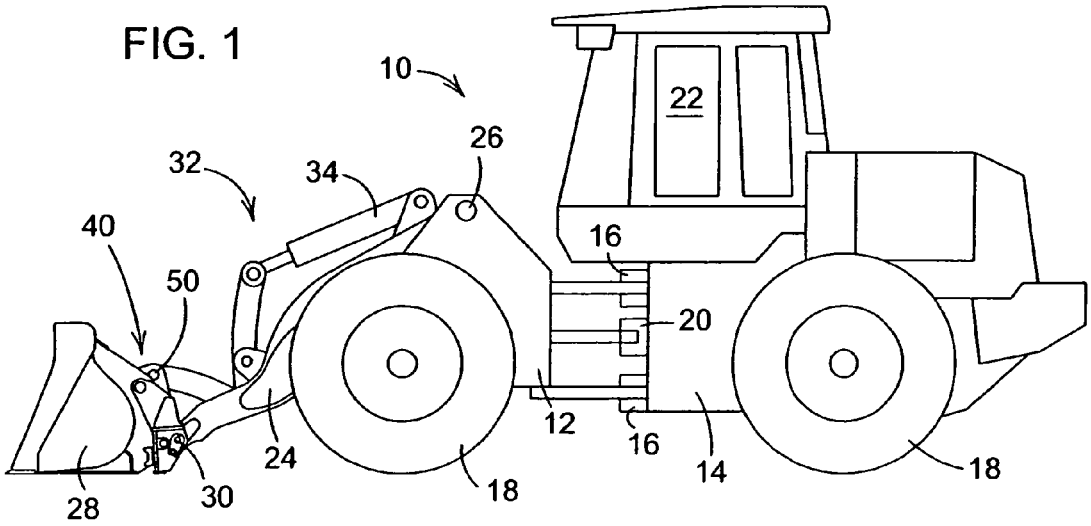
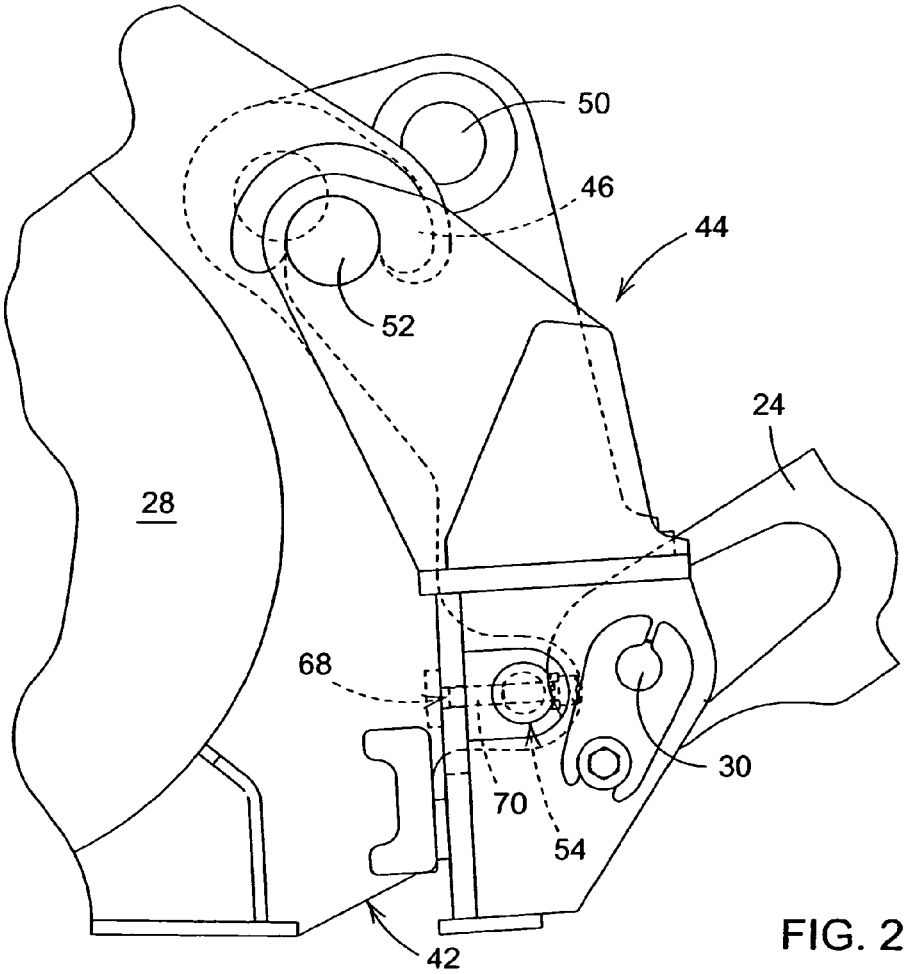
FIG. 2

TOOL COUPLER

FIELD OF THE INVENTION

The present invention is directed to a tool coupler using a single slidably mounted hydraulic cylinder to move two locking pins to lock a coupler frame to an attachment frame.

BACKGROUND OF THE INVENTION

Tool couplers for work vehicles are well known in the art. These couplers allow an operator to quickly switch from one tool attachment to another to perform a different operation. Tool couplers comprise an attachment frame mounted to the attachment and a coupler frame mounted to the work vehicle. The coupler frame may be provided with catches that engage hooks on the attachment frame. To lock the attachment frame to the coupler frame, slidable locking pins on the coupler frame are used to engage receiving apertures in the attachment frame.

U.S. Pat. No. 5,692,850 discloses a tool coupler wherein two locking pins are positioned by extending and retracting a hydraulic cylinder. The hydraulic cylinder is mounted to a coupler frame. The hydraulic cylinder has two piston rods having locking pins that engage receiving apertures on an attachment frame. The barrel of the hydraulic cylinder is fixedly mounted to the coupler frame.

SUMMARY OF THE INVENTION

It is an object of the present invention to provide a tool coupler that uses a single slidably mounted hydraulic cylinder to couple and uncouple two locking pins.

The tool coupler comprises a coupler frame mounted to the work vehicle and an attachment frame mounted to the tool. The attachment frame is provided with two downwardly opening hooks that engage two transverse catches located on the coupler frame. The coupler frame is provided with two transversely arranged locking pins and the attachment frame is provided with two transversely arranged receiving apertures, for locking the coupler frame to the attachment frame. Both locking pins are actuated by a single double acting hydraulic cylinder that is in line with the locking pins. The hydraulic cylinder has an extended coupled position, wherein the locking pins are extended to engage the receiving apertures, and a retracted uncoupled position, wherein the locking pins are withdrawn from the receiving apertures.

The hydraulic cylinder is slidably mounted on the coupler frame. The hydraulic cylinder is provided with a piston rod having the first locking pin and a barrel end having the second locking pin. The piston rod is extended from and retracted into the barrel end. Both locking pins are slidably positioned in bosses mounted to the coupler frame. Each boss is provided with a through passage for receiving and guiding the respective locking pin. The pin is received in the boss when the hydraulic cylinder is in its extended coupled position and its retracted uncoupled position. The coupler frame and the hydraulic cylinder are provided with limiters which limit the sliding movement of the piston rod and the barrel end of the hydraulic cylinder relative to the coupler frame. The piston rod limiter limits the sliding movement of the piston rod relative to the coupler frame and the barrel end limiter limits the sliding movement of the barrel end relative to the coupler frame. Each limiter comprises a slot formed in the coupler frame and a pin extending from the respective portion of the hydraulic cylinder that engages the slot. The slots are parallel to the longitudinal axis of the hydraulic cylinder and are sized in the transverse direction to keep the locking pins in the bosses. Therefore, as the locking pins are extended and retracted the locking pins maintain contact with and are guided by the bosses.

BRIEF DESCRIPTION OF THE DRAWINGS

FIG. 1 is a side view of a work vehicle having a tool coupler.

FIG. 2 is an enlarged side view of the tool coupler.

DETAILED DESCRIPTION

Figure 3:
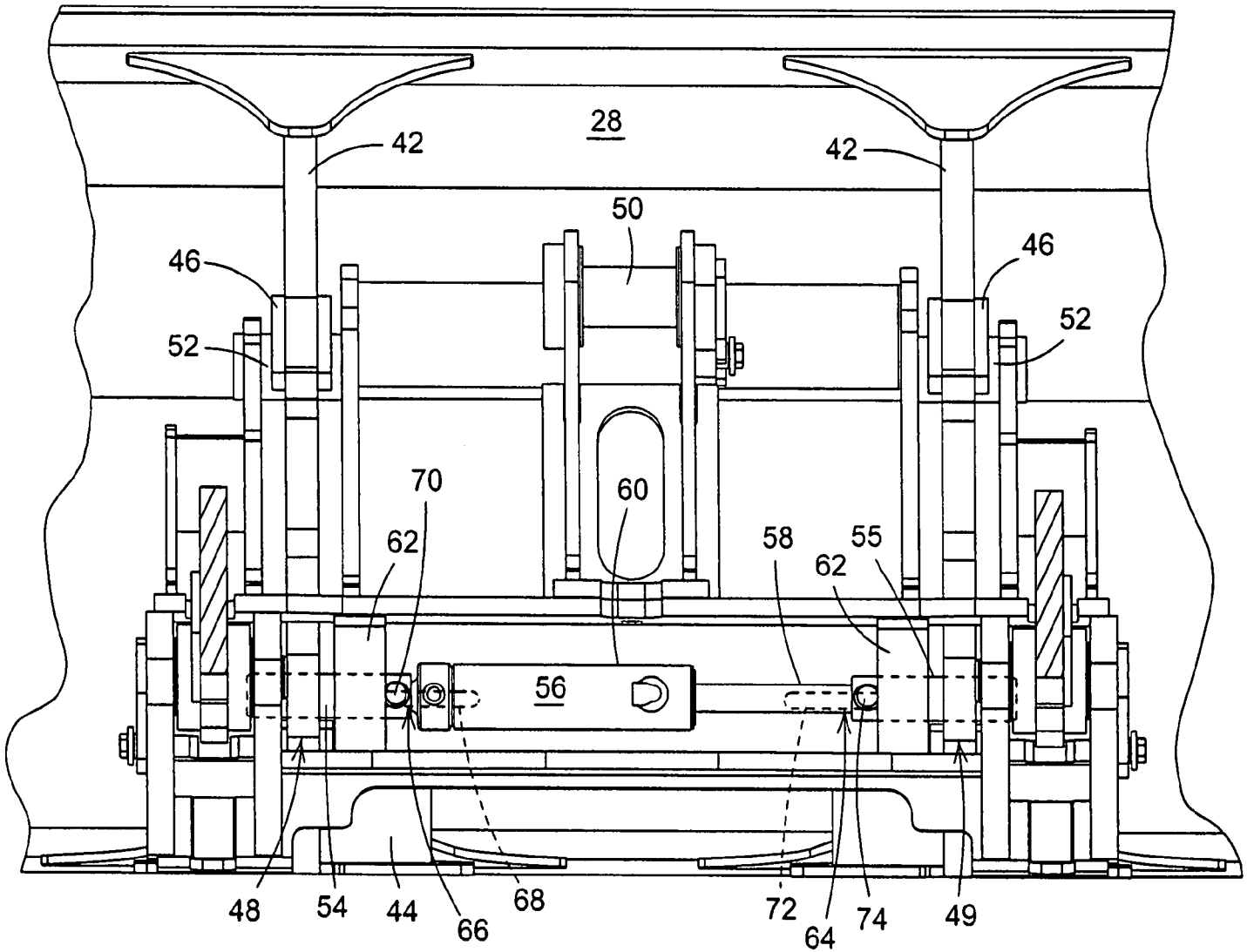
FIG. 3 is a rear view of the tool coupler with the hydraulic cylinder in its extended coupled position.

The work vehicle illustrated in FIG. 1 is a four wheel drive loader 10. The loader 10 comprises a front frame portion 12 and a rear frame portion 14 that are pivotally coupled to one another by a vertical articulation joint 16. Each frame portion is provided with a pair of drive wheels 18. The rear frame portion 14 houses an engine and transmission that drives the wheels 18. A telescoping drive shaft, not shown, extends across the articulation joint 16 to power the front pair of wheels 18. The loader 10 is steered by pivoting the frame portions 12 and 14 about the articulation joint 16 by steering hydraulic cylinders 20. The operation of the loader is controlled by an operator located in an operator's cab 22.

The front frame portion 12 is provided with a boom 24 that is pivotally attached to the front frame portion 12 at pivot 26. Boom hydraulic cylinders, not shown, lift and lower the boom 24 relative to the front frame portion 12. A tool in the form of a bucket 28 is pivotally coupled to the boom 24 at pivot 30. The position of the bucket 28 relative to the boom 24 is controlled by bucket linkage 32 and bucket hydraulic cylinder 34. Although the present invention is disclosed as being mounted on a four wheel drive loader 10 it can also be used on skid steer loaders, backhoe loaders, crawlers and other work vehicles.

The bucket 28 is mounted to the boom 24 by a tool coupler 40. The tool coupler 40 allows other tools, for example material handling forks, or jib booms, or snow blowers, or other tool attachments to be readily coupled to the loader 10. The tool coupler comprises an attachment frame 42 mounted to the bucket 28 and a coupler frame 44 mounted to the boom 24 of the loader 10. The attachment frame 42 comprises two downwardly opening hooks 46 located above two transversely arranged receiving apertures 48 and 49.

The coupler frame 44 is pivotally mounted to the boom 24 at pivots 30 and to the bucket linkage at pivot 50. The coupler frame 44 is also provided with two transversely arranged cylindrical catches 52 that are used to engage downwardly opening hooks 46 of the attachment frame 42. The coupler frame 44 is locked to the attachment frame 42 by transversely arranged locking pins 54 and 55 that engage the receiving apertures 48 and 49 on the attachment frame 42. The position of the locking pins 54 and 55 is controlled by a single hydraulic cylinder 56. The hydraulic cylinder 56 is a double acting hydraulic cylinder that is slidably mounted on the coupler frame 44. The hydraulic cylinder 56 has an extended coupled position and a retracted uncoupled position.

Figure 4:
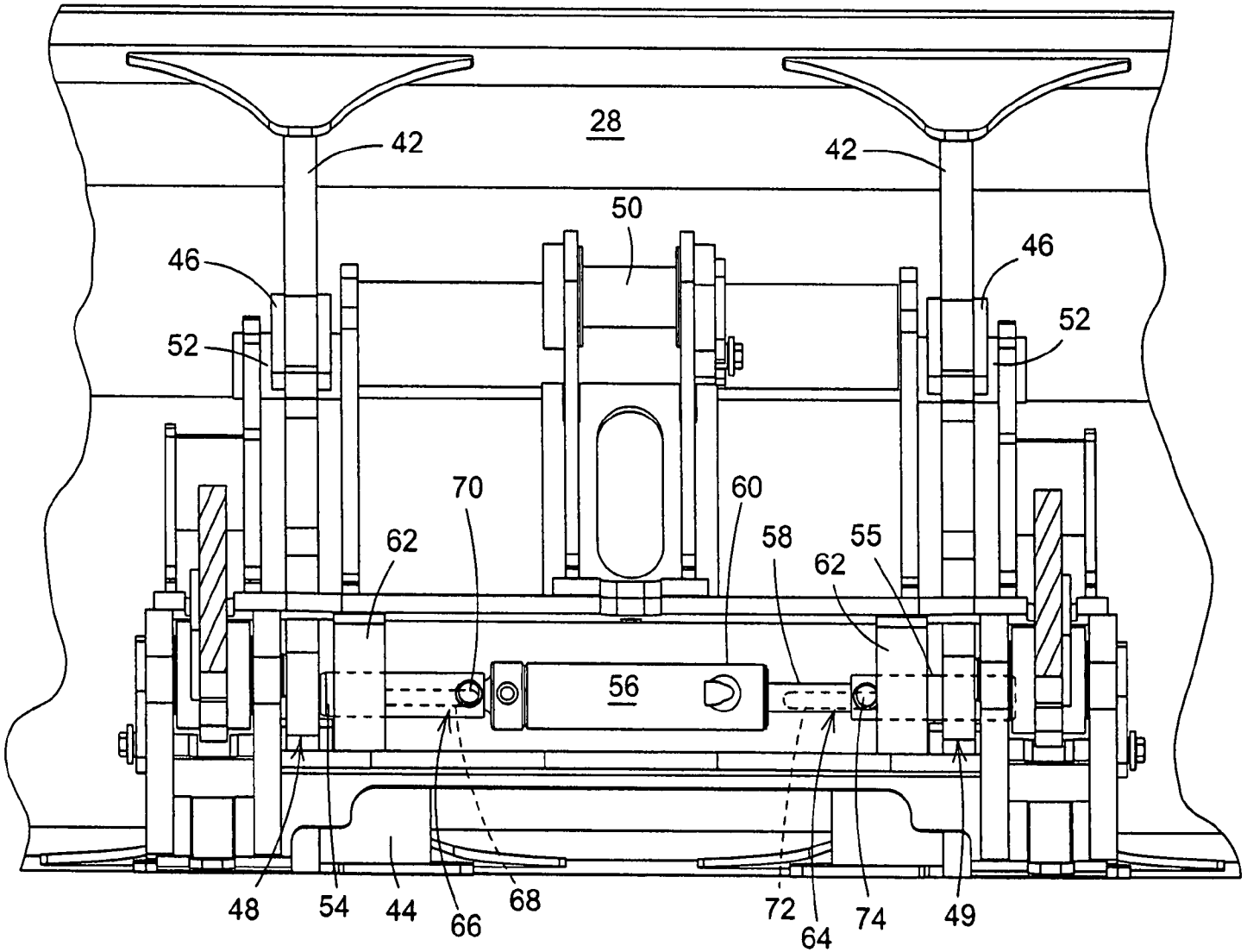
FIG. 4 is a rear view of the tool coupler with the hydraulic cylinder halfway between its extended locking position and its retracted uncoupled position.
Figure 5:
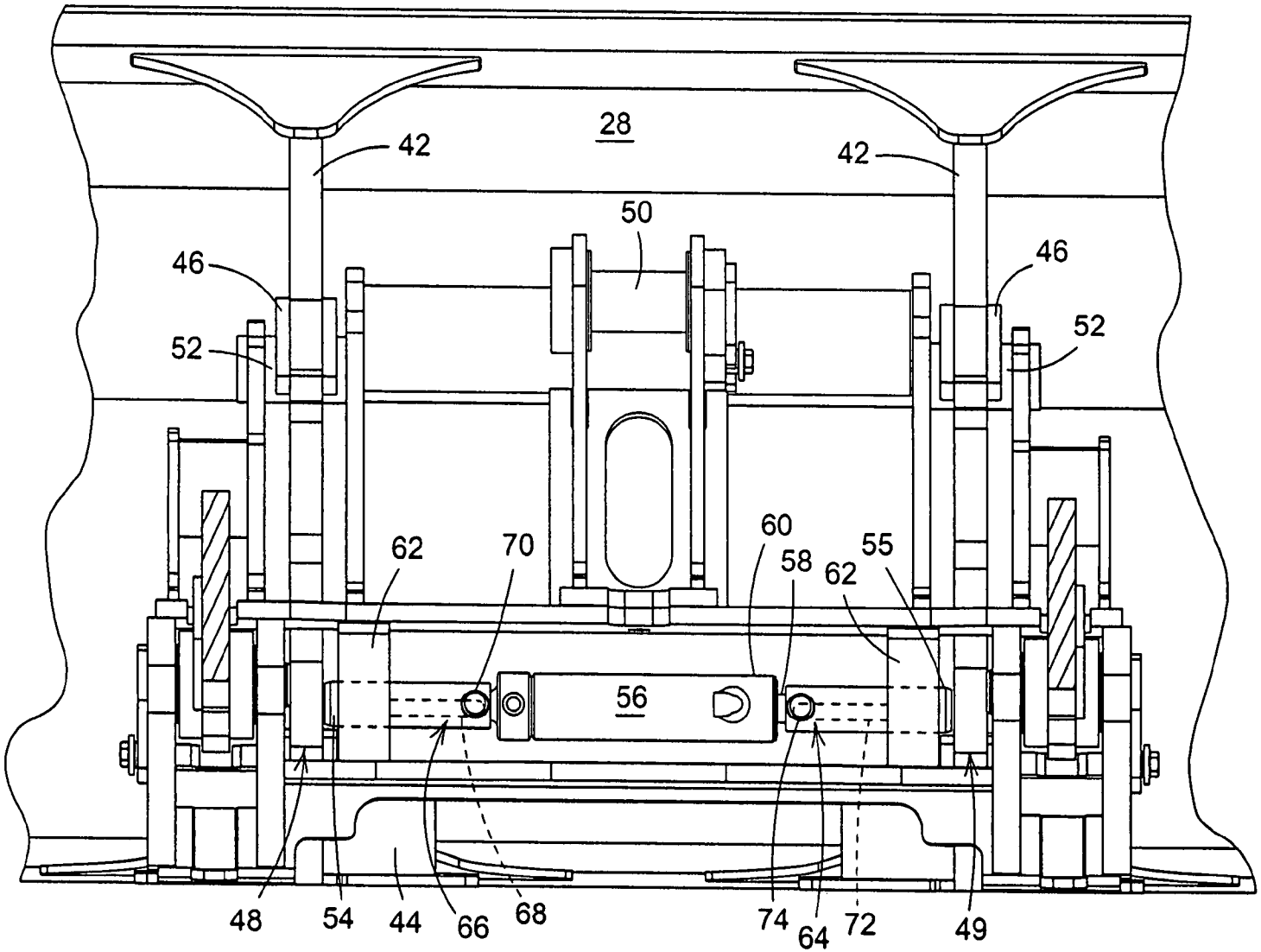
FIG. 5 is a rear view of the tool coupler with the hydraulic cylinder in its retracted uncoupled position.

The hydraulic cylinder 56 has a piston rod 58 that is slidably received in the barrel end 60. By using pressurized hydraulic fluid, the piston rod 58 is extended from and retracted into the barrel end 60. The piston rod 58 is provided with the second locking pin 55 and the barrel end 60 is provided with the first locking pin 54. The locking pins 54 and 55 are received and guided by bosses 62 mounted to the coupler frame 44. Each of the bosses 62 have a through passage into which the respective locking pin is received and guided. As shown in FIGS. 3, 4 and 5 the locking pins 54 and 55 are always in contact with the bosses 62 whether the hydraulic cylinder 56 is fully extended or fully retracted.

As the hydraulic cylinder 56 is slidably mounted on the coupler frame 44, it is necessary to limit the relative movement of the piston rod 58 and the barrel end 60 relative to the coupler frame 44. The coupler frame 44 is provided with a piston rod limiter 64 and a barrel end limiter 66 that limits the sliding movement of the piston rod 58 and barrel end 60, respectively. The piston rod limiter 64 comprises a piston rod slot 72 formed in the coupler frame 44 and a piston rod pin 74 that rides in the slot 72. Similarly, the barrel end limiter 66 comprises a barrel end slot 68 formed in the coupler frame 44 and a barrel end pin 70 that rides in the slot 68. As the hydraulic cylinder 56 is retracted from its extended coupled position to its retracted uncoupled position, the piston rod 58 and the barrel end 60 may not move in unison with one element moving more than the other. The limiters 64 and 66 allow the elements to move a defined amount before stopping the respective element's movement relative to the coupler frame 44. The slots 68 and 72 are parallel to the longitudinal axis of the hydraulic cylinder 56 and are sized to maintain the locking pins 54 and 55 in their respective bosses 62.

Having described the illustrated embodiment, it will become apparent that various modifications can be made without departing from the scope of the invention as defined in the accompanying claims.

What is claimed is:

1. A tool coupler for coupling an attachment to a work vehicle, the tool coupler comprising:

an attachment frame mounted to the attachment, the attachment frame having a first aperture and a second aperture;

a coupler frame mounted to the work vehicle;

a hydraulic cylinder slidably mounted on the coupler frame, the hydraulic cylinder having a piston rod and a barrel end, both the piston rod and the barrel end can slide relative to the coupler frame, the barrel end is provided with a first locking pin and the piston rod is provided with a second locking pin, the hydraulic cylinder having an extended coupled position and a retracted uncoupled position, when the attachment and coupler frames adjoin one another and the hydraulic cylinder is placed in its extended coupled position the first locking pin engages the first aperture and the second locking pin engages the second aperture coupling the attachment frame to the coupler frame, wherein the entire barrel end slides with the first locking pin towards the first aperture, the piston rod is slidably mounted to the coupler frame, sliding of the piston rod relative to the coupler frame is limited by a piston rod limiter engaging the piston rod and the coupler frame and the piston rod limiter comprises a piston rod slot formed in the coupler frame and a piston rod pin extending from the piston rod that engages the piston rod slot.

2. The tool coupler as defined by claim 1 wherein the barrel end is slidably mounted to the coupler frame, sliding of the barrel end relative to the coupler frame is limited by a barrel end limiter engaging the barrel end and the coupler frame.

3. The tool coupler as defined by claim 1 wherein the hydraulic cylinder has a longitudinal axis that passes through the first and second locking pins.

4. A tool coupler for coupling an attachment to a work vehicle, the tool coupler comprising:

an attachment frame mounted to the attachment, the attachment frame having a first aperture and a second aperture;

a coupler frame mounted to the work vehicle;

a hydraulic cylinder slidably mounted on the coupler frame, the hydraulic cylinder having a piston rod and a barrel end, both the piston rod and the barrel end can slide relative to the coupler frame, the barrel end is provided with a first locking pin and the piston rod is provided with a second locking pin, the hydraulic cylinder having an extended coupled position and a retracted uncoupled position, when the attachment and coupler frames adjoin one another and the hydraulic cylinder is placed in its extended coupled position the first locking pin engages the first aperture and the second locking pin engages the second aperture coupling the attachment frame to the coupler frame, wherein the entire barrel end slides with the first locking pin towards the first aperture, the barrel end being slidably mounted to the coupler frame, sliding of the barrel end relative to the coupler frame being limited by a barrel end limiter engaging the barrel end and the coupler frame, the barrel end limiter comprising a barrel end slot formed in the coupler frame and a barrel end pin extending from the barrel end that engages the barrel end slot.

5. The tool coupler as defined by claim 4 wherein the piston rod is slidably mounted to the coupler frame, sliding of the piston rod relative to the coupler frame is limited by a piston rod limiter engaging the piston rod and the coupler frame.

6. The tool coupler as defined by claim 5 wherein the piston rod limiter comprises a piston rod slot formed in the coupler frame and a piston rod pin extending from the piston rod that engages the piston rod slot.

7. The tool coupler as defined by claim 6 wherein the hydraulic cylinder has a longitudinal axis and the barrel end slot and the piston rod slot are parallel to the longitudinal axis of the hydraulic cylinder.

8. The tool coupler as defined by claim 7 wherein the coupler frame is provided with a first boss for receiving and guiding the first pin and a second boss for receiving and guiding the second pin, the first pin is received in the first boss and the second pin is received in the second boss in both the extended coupled position and the retracted uncoupled position of the hydraulic cylinder.

9. The tool coupler as defined by claim 8 wherein the hydraulic cylinder is a double acting hydraulic cylinder.

10. The tool coupler as defined by claim 9 wherein the coupler frame is provided with two catches and the attachment frame is provided with two hooks which engage the catches when the attachment frame is coupled to the coupler frame.

11. A tool coupler for a work vehicle, the tool coupler comprising:

a coupler frame mounted to the work vehicle, the coupler frame having a first boss and a second boss;

a hydraulic cylinder slidably mounted on the coupler frame, the hydraulic cylinder having a piston rod and a barrel end, both the piston rod and the barrel end can slide relative to the coupler frame, the barrel end is provided with a first locking pin and the piston rod is provided with a second locking pin, the hydraulic cylinder having an extended coupled position and a retracted uncoupled position, in both the extended coupled position and the retracted uncoupled position the first locking pin is received and guided by the first boss and the second locking pin is received and guided by the second boss, wherein the entire barrel end slides with the first locking pin towards first aperture, the piston rod is slidably mounted to the coupler frame, sliding of the piston rod relative to the coupler frame is limited by a piston rod limiter engaging the piston rod and the coupler frame and the piston rod limiter comprises a piston rod slot formed in the coupler frame and a piston rod pin extending from the piston rod that engages the piston rod slot.

12. The tool coupler as defined by claim 11 wherein the barrel end is slidably mounted to the coupler frame, sliding of the barrel end relative to the coupler frame is limited by a barrel end limiter engaging the barrel end and the coupler frame.

13. A tool coupler for a work vehicle, the tool coupler comprising:

a coupler frame mounted to the work vehicle, the coupler frame having a first boss and a second boss;

a hydraulic cylinder slidably mounted on the coupler frame, the hydraulic cylinder having a piston rod and a barrel end, both the piston rod and the barrel end can slide relative to the coupler frame, the barrel end is provided with a first locking pin and the piston rod is provided with a second locking pin, the hydraulic cylinder having an extended coupled position and a retracted uncoupled position, in both the extended coupled position and the retracted uncoupled position the first locking pin is received and guided by the first boss and the second locking pin is received and guided by the second boss, wherein the entire barrel end slides with the first locking pin towards the first aperture, the barrel end being slidably mounted to the coupler frame, sliding of the barrel end relative to the coupler frame being limited by a barrel end limiter engaging the barrel end and the coupler frame, barrel end limiter comprising a barrel end slot formed in the coupler frame and a barrel end pin extending from the barrel end that engages the barrel end slot.

14. The tool coupler as defined by claim 13 wherein the piston rod is slidably mounted to the coupler frame, sliding of the piston rod relative to the coupler frame is limited by a piston rod limiter engaging the piston rod and the coupler frame.

15. The tool coupler as defined by claim 14 wherein the piston rod limiter comprise a piston rod slot formed in the coupler frame and a piston rod pin extending from the piston rod that engages the piston rod slot.

16. The tool coupler as defined by claim 15 wherein the hydraulic cylinder has a longitudinal axis and the barrel end slot and the piston rod slot are parallel to the longitudinal axis of the hydraulic cylinder.

17. The tool coupler as defined by claim 16 wherein the hydraulic cylinder is a double acting hydraulic cylinder and the longitudinal axis of the hydraulic cylinder passes through the bosses.

18. The tool coupler as defined by claim 17 wherein the coupler frame is provided with two catches and the attachment frame is provided with two hooks which engage the catches when the attachment frame is coupled to the coupler frame.

19. A tool coupler for a work vehicle, the tool coupler comprising:

a coupler frame mounted to the work vehicle, the coupler frame having a first boss and a second boss;

a hydraulic cylinder slidably mounted on the coupler frame, the hydraulic cylinder having a piston rod and a barrel end, both the piston rod and the barrel end can slide relative to the coupler frame, the barrel end is provided with a first locking pin and the piston rod is provided with a second locking pin, the hydraulic cylinder having an extended coupled position and a retracted uncoupled position, sliding of the barrel end relative to the coupler frame is limited by a barrel end limiter engaging the barrel end and the coupler frame and sliding of the piston rod relative to the coupler frame is limited by piston rod limiter engaging the piston rod and the coupler frame, wherein the entire barrel end slides with the first locking pin towards a first aperture, the barrel end being slidably mounted to the coupler frame, sliding of the barrel end relative to the coupler frame being limited by a barrel end limiter engaging the barrel end and the coupler frame, the barrel end limiter comprising a barrel end slot formed in the coupler frame and a barrel end pin extending from the barrel end that engages the barrel end slot.

20. The tool coupler as defined by claim 19 wherein the hydraulic cylinder is a double acting hydraulic cylinder having a longitudinal axis that passes through the first and second locking pins.

* * * * *